US005181324A

United States Patent [19]

Hein

[11] Patent Number: 5,181,324

[45] Date of Patent: Jan. 26, 1993

[54] SUNDIAL

[75] Inventor: Piet Hein, Damsbo, Denmark

[73] Assignee: Piet Hein A/S, Middelfart, Denmark

[21] Appl. No.: 772,354

[22] PCT Filed: Apr. 27, 1990

[86] PCT No.: PCT/DK90/00110

§ 371 Date: Dec. 19, 1991

§ 102(e) Date: Dec. 19, 1991

[87] PCT Pub. No.: WO90/13854

PCT Pub. Date: Nov. 15, 1990

[30] Foreign Application Priority Data

Apr. 28, 1989 [DK] Denmark ..... 2096/89

[51] Int. Cl.[5] ..... G04B 49/02

[52] U.S. Cl. ..... 33/270; 33/268

[58] Field of Search ..... 33/268, 269, 270

[56] References Cited

U.S. PATENT DOCUMENTS

| | | | |
|---|---|---|---|
| 155,327 | 9/1874 | Mehr | 33/270 |
| 783,245 | 2/1905 | Clarke | 33/270 |
| 2,072,565 | 3/1937 | Moehle | 33/270 |
| 2,473,487 | 6/1949 | Byerly . | |
| 2,754,593 | 7/1956 | Sundblad . | |
| 3,158,937 | 12/1964 | Flinois . | |
| 3,417,473 | 12/1968 | Troseth | 33/269 |
| 3,815,249 | 6/1974 | Gundlach | 33/269 |
| 4,135,357 | 1/1979 | Ashton | 33/270 |
| 4,255,864 | 3/1981 | Glendinning | 33/270 |
| 4,338,727 | 7/1982 | Gundlach | 33/269 |
| 4,355,470 | 10/1982 | Doyle | 33/270 |
| 4,384,408 | 5/1983 | Bohlayer | 33/270 |
| 4,922,619 | 5/1990 | Singleton | 33/270 |

FOREIGN PATENT DOCUMENTS

| | | |
|---|---|---|
| 379409 | 2/1964 | Switzerland . |
| 2212630 | 7/1989 | United Kingdom . |

OTHER PUBLICATIONS

Cousins, Frank W., *Sundials: A Simplified Approach by Means of the Equatorial Dial*, pp. 148–151, no date.

*Primary Examiner*—Thomas B. Will

*Attorney, Agent, or Firm*—Cushman, Darby & Cushman

[57] ABSTRACT

A sundial including a strip-shaped body with surfaces substantially in the form of helicoids. The body is made of a rather thin material. At least one of the helicoids is provided with time markings. As a result, the sundial is very simple to manufacture, and it is very easy to set up. Moreover, it is very easy to read the time, even at a relatively long distance.

9 Claims, 4 Drawing Sheets

SUNDIAL

TECHNICAL FIELD

The invention relates to a sundial comprising a body and a base therefor.

BACKGROUND ART

Sundials have been known for a long time, which have an inclining gnomon bar, which in sunny weather casts a shadow on a curved scale body provided with indications of the time. As a result, the time can be directly read from the spot where the shadow falls. The manufacturing of such a sundial involves a good many working steps, and furthermore the parts of the sundial must be assembled rather exactly. In addition, it is difficult to read the time at a long distance, such as a few meters away from it, because the shadow cast by the bar on the scale body is relatively small.

A sundial of this type is known from U.S. Pat. No. 2,754,593. The scale body is supported by a holder which is bolted to a base. This construction is rather complex and expensive to produce.

SUMMARY OF THE INVENTION

The object of the invention is to provide a sundial which is very simple to manufacture and to set up, and which allows an easy reading of the time even at a relatively long distance.

The sundial according to the invention is characterised in that the body is a strip-shaped body having surfaces substantially formed as helicoids, the body being made of a rather thin material, and that at least one of the helicoids is provided with time markings, so that when subjected to sunshine, the body casts a relatively wide sharp-edged time indicative shadow on itself, the shadow edge moving upwards and downwards on the body as the sun moves around the body. In this manner the manufacture of the sundial is very simple. No special gnomon bar is necessary. The time indicated by the sundial is read at the time marking on the helicoid which the front rim of the shadow has reached. When the sundial is set up, care should be taken that the body inclines correctly relative to the path of the sun, i.e. in such a manner that the longitudinal axis of the body is parallel to the earth's axis of rotation, i.e., that the longitudinal axis is pointing towards the North Star.

According to the invention the strip-shaped body may be constituted by a flat bar twisted, for instance 360°, about its longitudinal axis, whereby a particularly simple manufacturing of the sundial is obtained.

In addition according to the invention the helicoids of the strip-shaped body may advantageously be right helicoids.

According to the invention, it is preferred that the time markings are non-equidistant and placed near the longitudinal axis of the helicoids.

Moreover according to the invention the time markings may be provided on both helicoids of the strip-shaped body, whereby the sundial is particularly easy to read because it is no longer necessary to move particularly far to find a good reading position. The two sets of time markings normally oppose one another.

According to the invention, the ratio of the thickness to the width of the strip-shaped body may be in the range of 0.01 to 0.1, whereby the sundial is provided with a suitable strength and is rather easy to read.

Furthermore, according to the invention, the ratio of the width to the length of the strip-shaped body may be in the range 0.02 to 0.2, whereby the resulting shadow is of such a width that it is easy to find and read for an observer standing rather far from the sundial.

An embodiment of the sundial comprises a holder for the body, the holder for instance being a circularly curved bar preferably of an arc of measure of at least 180°, and a standard for the holder, this embodiment being characterised in that the strip-shaped body is placed along a diameter of the holder, the axis of the strip-shaped body being adjustable parallel to the earth's axis of rotation. The resulting sundial is very easy to adjust.

Moreover, according to the invention, the holder may be an inclining bar, and the strip-shaped body may be arranged in extension thereof, whereby an extremely simple construction of the sundial is obtained.

The strip-shaped body is advantageously made of a weather-proof material, such as bronze or stainless steel.

A releasable connection, such as a connection by way of a locking screw, may be provided between the curved bar and the standard, whereby the inclination of the strip-shaped body is particularly easily adjustable.

BRIEF DESCRIPTION OF THE DRAWINGS

The invention is described in greater detail below with reference to the accompanying drawings, in which.

DETAILED DESCRIPTION

Figure 1:
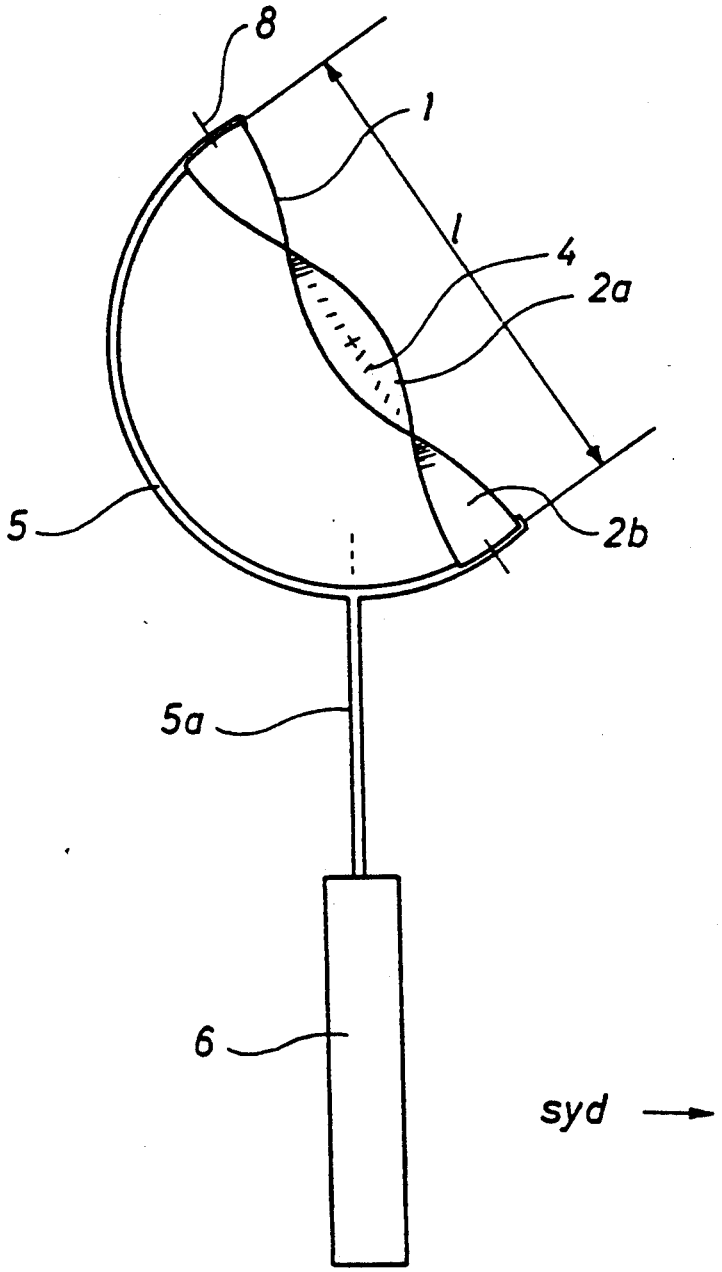
FIG. 1 is a side view of an embodiment of the sundial according to the invention.
Figure 2:
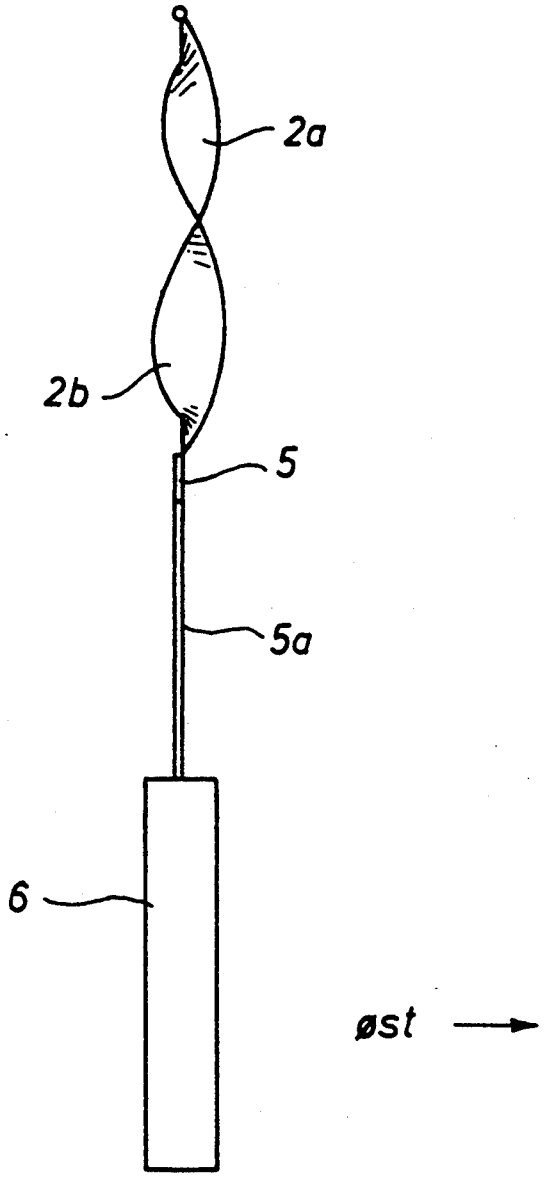
FIG. 2 is an end view of the embodiment of FIG. 1.

The sundial of FIGS. 1 and 2 comprises a strip-shaped body 1 with surfaces 2*a*, 2*b* substantially in the form of helicoids. Time markings 4 are provided on the helicoid 2*a*, said time markings allowing a reading of the time by means of the shadow cast by the body 1 on itself, see the more detailed explanation below. The body 1 may be mounted on a holder 5, which, as illustrated, can be a circularly curved bar preferably of an arc of measure of at least 180°. In addition a standard 5*a* is provided, which is secured to a base 6.

When the sundial is to be set up, the body 1 is arranged in such a manner that its longitudinal axis 8 is parallel to the earth's axis of rotation, i.e. the axis is pointing towards the North Star.

The helicoids 2*a* and 2*b* preferably have a constant pitch and are preferably right helicoids.

In description and claims "helicoid" means a surface produced by screwing a curve, whereby the points of the curve pass through helices of the same helical pitch.

The expression "right helicoid" means a helicoid formed by the principals of a helix.

The strip-shaped body 1 may as indicated be made of a flat bar, which has been twisted for instance 360° about its longitudinal axis 8.

Figure 3:
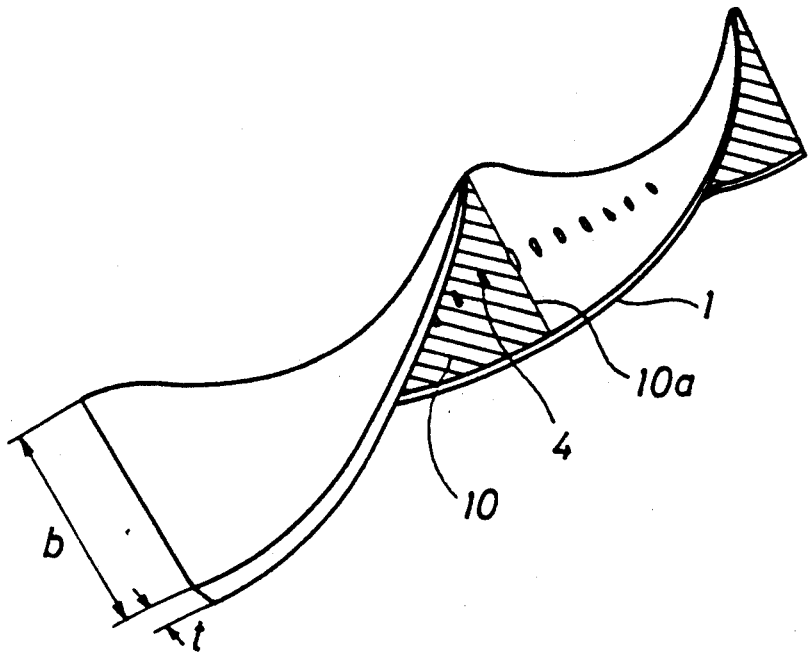
FIG. 3 illustrates a portion of the strip-shaped body, where the time markings appear clearly and the sun casts a shadow.

As illustrated in FIG. 3, the time markings 4 are usually equidistant and placed near the longitudinal axis of the helicoid 2*a*, on which the shadow 10 cast by the sun falls when the sundial is in use. The front rim 10*a* of the shadow 10 indicates the time.

Time markings may optionally exist both on the helicoid 2a and the helicoid 2b, only one set of time markings 4 being shown, for the sake of clarity.

The ratio of the thickness t to the width b of the strip-shaped body 1, see FIG. 3, is preferably in the range 0.01 to 0.1, whereas the ratio of the width b to the length 1 of the strip-shaped body 1, of FIG. 1, is preferably in the range 0.02 to 0.2.

As illustrated in FIG. 1, the strip-shaped body 1 may be placed along a diameter of the circularly curved bar 5. It is also possible to vary the point on the bar 5 to which the standard 5a is secured in such a manner that the body 1 can be caused to incline more or less. The connection between the bar 5 and the standard 5a is preferably a releasable connection, such as a connection by way of a locking screw, but it may be shaped in many other ways.

Figure 4:
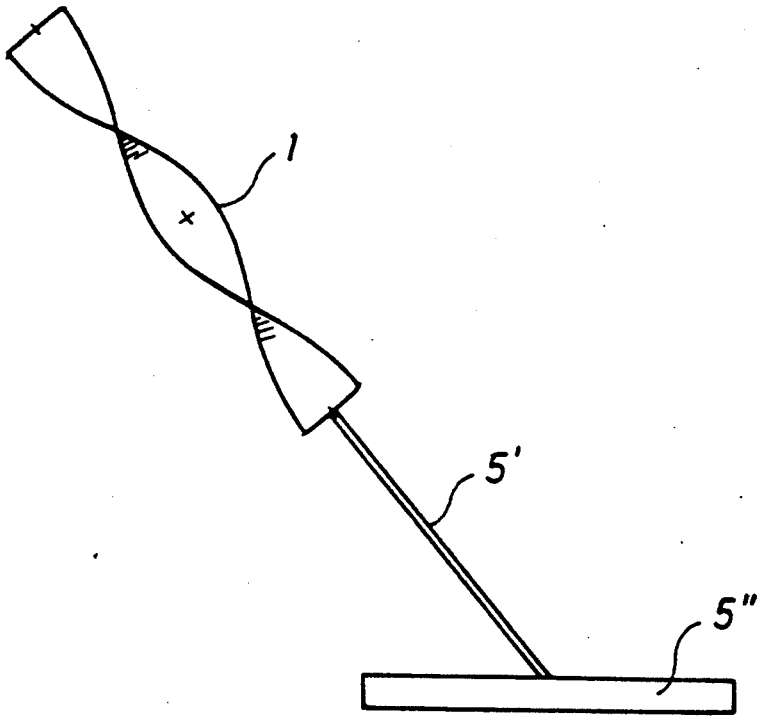
FIG. 4 illustrates an embodiment of the sundial with a holder formed as a single inclining bar, on a base.

FIG. 4 illustrates how the holder can be an inclining bar 5' provided with a base 5'', where the strip-shaped body 1 is arranged in immediate extension of the bar 5'.

The strip-shaped body may be made of a weatherproof material, such as bronze or stainless steal, but many other materials may be used, such as plastics, ceramics or glass.

The invention may be modified in many ways without thereby deviating from the scope thereof. Thus each helicoid on the strip-shaped body may have a varying pitch, in which case the time markings are non-equidistant. As to the time markings, they may be small elevations or recesses on and in the helicoids. The elevations may be situated at the rim of the strip-shaped body so that they are particularly evident when seen against the sky.

A sundial set up at about 10 m above level comprises suitably a strip-shaped body 1 of a length of about 4 m, a width of about 40 cm, and a thickness of about 1 cm.

It should be observed that the helicoids 2a, 2b need not strictly be helicoids, but may deviate a little therefrom, for instance by certain deformations, such as waves, projections, etc., at more or less regular intervals.

The helicoids may be twisted to the right or to the left according to desire. In the two cases, corresponding shadows move in opposite directions.

The strip-shaped body, such as the flat bar, may be of a varying width, such as uniformly decreasing from total width at one end of the body to half width at the opposite end. The strip-shaped body of small sundials may be of a thickess of a very few millimeters.

I claim:

1. A sundial, comprising:

a strip-shaped body having two opposite faces, two opposite ends, two opposite edges and a longitudinal axis, said body being longer than it is wide, and wider than it is thick; both of said faces being provided as respective helicoidal surfaces extending helicoidally about said longitudinal axis, and between said ends and said edges; means providing a longitudinally extending series of time markings on at least one of said helicoidal surfaces; and a base; said body being arranged to be supported on said base with said longitudinal axis parallel to the earth's axis of rotation, and so that as the earth rotates, said body casts a shadow at least partly defined by a said edge thereof generally crosswise of said strip on at least one of said surfaces having said series of time markings thereon, as a sole shadow-based visual indication of time of day provided by said sundial.

2. The sundial of claim 1, wherein:

said body is constituted by a bar on which said opposite ends are twisted 360° relative to one another, about said longitudinal axis.

3. The sundial of claim 1, wherein:

said helicoidal surfaces are both right helicoidal surfaces.

4. The sundial of claim 1, wherein:

said time markings are non-equidistant from one another along said series.

5. The sundial of claim 1, wherein:

said series of time markings is provided on both of said helicoidal surfaces.

6. The sundial of claim 1, wherein:

said body has a thickness-to-width ratio of 0.01 to 0.1.

7. The sundial of claim 6, wherein:

said body has a width to length ratio of 0.02 to 0.2.

8. The sundial of claim 1, wherein:

said body is adjustably mounted to said base by:

a circularly curved bar which longitudinally extends through an arc of at least 180°, opposite ends of said strip being mounted to said curved bar at two respectively diametrically opposed sites on said arc of said bar, and a holder mounting said bar to said base.

9. The sundial of claim 1, wherein:

said body is mounted to said base by an inclined bar which extends between an end of said body and said base along said longitudinal axis.

* * * * *